United States Patent [19]

Brandstetter

[11] 4,369,003

[45] Jan. 18, 1983

[54] ROCK ANCHORS

[75] Inventor: Frederick P. Brandstetter, Salzburg, Fed. Rep. of Germany

[73] Assignee: Gebirgssicherung GmbH, Salzburg, Austria

[21] Appl. No.: 117,091

[22] Filed: Jan. 31, 1980

[30] Foreign Application Priority Data

Jan. 31, 1979 [DE] Fed. Rep. of Germany ..... 2903694

[51] Int. Cl.[3] ..... E21D 21/00

[52] U.S. Cl. ..... 405/260

[58] Field of Search ..... 411/55, 63, 65, 64, 411/70, 71, 15; 52/689, 749, 223 L, 223 R, 230; 405/259, 260

[56] References Cited

U.S. PATENT DOCUMENTS

| | | | |
|---|---|---|---|
| 2,180,866 | 11/1929 | Cryer | 52/223 L |
| 2,442,113 | 5/1948 | Beijl | 405/259 |
| 2,525,198 | 10/1950 | Beijl | 405/259 |
| 2,667,037 | 1/1954 | Thomas | 405/260 |
| 2,682,152 | 6/1954 | Bierer | 405/260 |
| 2,879,686 | 3/1959 | Lewis | 405/259 |
| 2,934,935 | 5/1960 | Zerna | 52/223 L |
| 3,226,934 | 1/1966 | Emery | 405/259 |
| 3,306,051 | 2/1967 | Howlett | 405/260 |
| 3,311,012 | 3/1967 | Williams | 405/260 |
| 3,837,258 | 9/1974 | Williams | 405/260 |
| 4,034,567 | 7/1977 | Roggen | 405/259 |
| 4,139,323 | 2/1979 | Brandstetter | 405/260 |

FOREIGN PATENT DOCUMENTS

| | | | |
|---|---|---|---|
| 1461377 | 12/1966 | France | 411/377 |

*Primary Examiner*—John E. Murtagh

*Attorney, Agent, or Firm*—Haight & Associates

[57] ABSTRACT

A rock anchor assembly comprising a tensioning element adapted to be inserted into a bore hole and to be clamped therein, the outer end of which projecting from said bore hole being adapted to be tensioned against a rock wall by means of an anchor plate, the inner end of said tensioning element inserted into the bore hole being provided with a spreading jacket clinging into said bore hole and being adapted for tensioning with the inner end of the tensioning element by means of a spreading wedge upon turning a clamp nut, and wherein said clamp nut is screwed on a threaded tensioning jacket being adapted for tensioning with the outer end of said tensioning element with the aid of tensioning wedge means upon turning the clamp nut. A method of installing said rock anchor in a wall is also provided.

14 Claims, 9 Drawing Figures

ROCK ANCHORS

BACKGROUND AND SUMMARY OF THE INVENTION

The present invention relates to a rock anchor assembly. It particularly relates to a rock anchor assembly comprising a tensioning element adapted to be inserted into a bore hole and to be clamped therein, the outer end of which projecting from said bore hole being adapted to be tensioned against a rock wall by means of an anchor plate. The invention also relates to a method of installing said rock anchor in a wall.

German Offenlegungsschrift 2 624 559 of the present inventor discloses a rock anchor assembly of the above type wherein the tensioning element is formed of a steel pipe, the outer end of which is threaded so that a clamp nut may be secured thereon. Reinforcing elements in the form of glass fiber—synthetic resin rods are inserted into the steel pipe. The rock anchor is installed in a bore hole formed in a wall by means of a liquid synthetic resin. After hardening of the injected liquid resin the anchor assembly is tensioned against the wall with the aid of the anchor plate using said clamp nut.

These known rock anchors have proven to be effective in practice, because in view of the hardenable resin they may be installed in a bore hole in a relatively simple manner. Further they may be put under tensile stress by means of the clamp nut and the anchor plate so that the rock materials overneath are securely fastened.

It is an object of the invention to provide a rock anchor comprising only a small number of pre-fabricated parts which in accordance with the particular requirements may be assembled at the construction site, which rock anchors may also be anchored in a rock material without an indispensable need of injecting synthetic resin.

It is another object of the invention to provide a method of installing a rock anchor in a wall using said rock anchor assembly.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The above objects are achieved according to the invention by the provision of a rock anchor assembly comprising a tensioning element adapted to be inserted into a bore hole and to be clamped therein, the outer end of which projecting from said bore hole being adapted to be tensioned against a rock wall by means of an anchor plate, the inner end of said tensioning element inserted into the bore hole being provided with a spreading jacket clinging into said bore hole and being adapted for tensioning with the inner end of the tensioning element by means of a spreading wedge upon turning a clamp nut, and wherein said clamp nut is secured on a threaded tensioning jacket adapted for tensioning with the outer end of said tensioning element with the aid of tensioning wedge means upon turning the clamp nut.

A substantial advantage of the rock anchor according to the invention is that it features a simple construction. Thus, according to the particular requirements at the place of application of the rock anchor the smooth tubular tensioning element, which does not require a thread for securing the clamp nut, is cut to the required length. Thereafter the spreading means comprising a spreading jacket and a spreading wedge are positioned onto the inner end. The tensioning means, comprising a tensioning jacket, a tensioning device, for example a tensioning wedge, a clamp nut and the anchor plate are placed on the outer end of the tensioning element. In spite of this simple construction of the rock anchor, which may be assembled exceptionally fast and economically, it provides an excellent hold in rock walls, because the spreading jacket, which on its outer surface is provided with barbs or similar projections, clings fast in the bore hole.

According to a preferred embodiment of the invention the tensioning element has a tubular configuration with both ends of the tensioning element being adapted to be conically widened and both being provided with cross wedges with an axial injection bore for introducing a filling material.

According to this embodiment of the rock anchor in those cases, where an anchoring with the aid of the spreading jacket in the bore hole may not be sufficient, a hardenable synthetic resin may be injected through the cross wedge positioned on the outer end, whereby the anchoring in the bore hole is further improved.

According to another preferred embodiment of the invention the ends of the tensioning element, which may be conically widened, are provided with crosswise positioned slots while the cross wedges or spreading wedges have a radial shape such that their arms or projections engage into said slots.

This embodiment of the cross wedges or spreading wedges has the advantage that with increased tensile stress the the material of the tensioning element will not penetrate into the slots which would impair the secure functioning of the rock anchor.

Instead of the tensioning wedge being positioned between the conically tapered inner end of the tensioning jacket and the essentially cylindrical end of the tensioning element, the tensioning device may consist of the conically widened end of the tensioning element and an opening in said tensioning element paired therewith being of conical shape on at least part of its length. This alternative construction has as an advantage that the outer surface of the tensioning element may have a cylindrical form over its entire length and may thus be provided with a very long thread. Also, the injection bore of the cross wedge directly located at the head of the rock anchor is exposed so that an easier operation is possible.

According to a further feature of the invention the tensioning element may have the form of a smooth glass fiber reinforced synthetic resin pipe. The advantage resulting therefrom is that a very light and easily transportable material for the tensioning element is provided which at the construction site may easily be cut to the desired length. No reduction of the tensile strength of the rock anchor assembly will result therefrom. Instead of the smooth glass fiber-synthetic resin pipe it is also feasible to use a roughened glass fiber reinforced synthetic resin pipe.

According to an alternate preferred embodiment of the invention the tensioning element is of a solid configuration, i.e. has the form of a rod. This construction is particularly useful, if the rock anchor is intended for applications which involve a particularly high tensile stress. If the tensioning element has the form of a rod, it is preferred that tensioning shells are put onto both ends of the tensioning element. It is also possible to form the rod-like tensioning element such that both ends thereof are provided with crosswise slots into which correspondingly shaped cross wedges are inserted.

Further features and advantages of the invention will become more fully understood from the detailed description given herein below and the accompanying drawings, which are given by way of illustration only, and thus are not limitative of the present invention, and wherein, FIG. 1 is a longitudinal section of the tensioning anchor according to the invention with the middle part being omitted;

Figure 1:
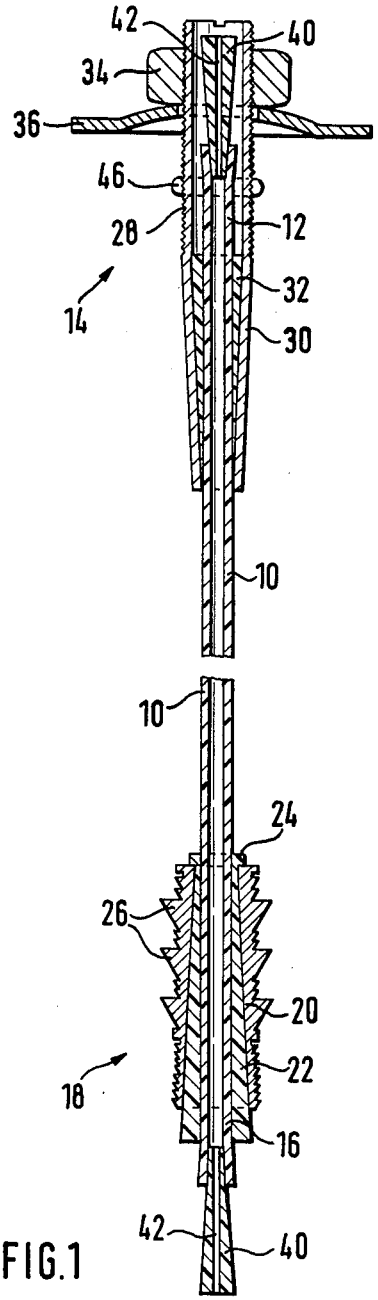
Figure 2:
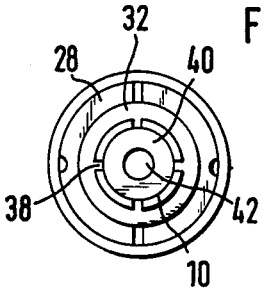
FIG. 2 is a front view of the outer end of the tensioning anchor with the clamp nut and the anchor plate being omitted.
Figure 3:
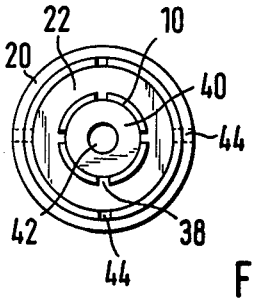
FIG. 3 is a front view of the inner end of the rock anchor.

The rock anchor as shown in FIGS. 1 to 3 comprises a tubular tensioning element 10 consisting of glass fiber reinforced synthetic resin, on the outer end 12 of which a tensioning means designated by numeral 14, is positioned, while its inner end 16 is provided with spreading means 18. The rock anchor is anchored in a bore hole with the aid of spreading means 19, while the outer end 12 provided with the tensioning means 14 partly projects from the bore hole to the exterior.

The spreading means 18 comprises a spreading jacket 20 with a conical inner opening and a spreading wedge 22 with a conical outer surface. The spreading wedge 22, which preferably consists of glass fiber reinforced synthetic resin, is provided at one end thereof, which has a smaller diameter, with a radially outwardly extending flange 24 against which the spreading jacket 20 may abut axially. On the outer surface of the spreading jacket 20 barbs 26 are provided, which may be wedged or otherwise fastened in a bore hole.

The tensioning means 14 is provided with a tensioning jacket 28 formed of metal or glass fiber reinforced synthetic resin. The end 20 thereof which projects into the bore hole, is conically tapered. Into the conical end 30 a tensioning wedge formed of glass fiber reinforced synthetic resin is inserted. On the cylindrical part of the tensioning wedge 32 a thread is provided to receive a clamp nut 34 with the aid of which an anchor plate 36 may be pressed against the rock wall.

Both the inner end 16 and the outer end 12 of the tensioning element 10 are crosswise provided with slots 38 so that spreading wedges 40 of glass fiber reinforced synthetic resin may each be forced into both ends, said spreading wedges 40 comprising an axial injection bore 42.

Upon application of the rock anchor assembly according to the invention the tubular tensioning element 10 is first cut to the required length. Thereafter on both ends 12 and 16 slots 38 are provided. In the thus prepared ends 12 and 16 a spreading wedge 40 is each inserted, after the spreading means 18 has been positioned on the inner end 16 and the tensioning means 14 has been positioned on the outer end 12. Thereafter the tensioning anchor is inserted into a bore hole and thereafter tensioned. To this end, clamp nut 34 is turned so that the anchor plate 36 is forced against the rock wall. Thereby the spreading jacket 20, the barbs 26 of which finding a hold in the bore hole, is moved relative to spreading wedge 32 in an axial direction and is widened—for this purpose the inner end of the spreading jacket 20 is provided with slots 44—until it clings in the bore hole so that no further relative movement is possible. By further turning clamp nut 34 the anchor plate 36 is pressed against the rock wall with the tensioning jacket 28 being fixed immovably on said tubular element 10 by means of tensioning wedge 32.

If necessary, a hardenable synthetic resin may subsequently be injected through injection bore 42 of the outer spreading wedge 40 up to sealing ring 46; the plastic or resin material adds to securing the rock anchor in the bore hole after hardening.

It is possible to manufacture all parts of the rock anchor assembly from glass fiber reinforced synthetic resin, which has the advantage that the anchor is corrosion resistant and stable against mountaneous waters.

Figure 4:
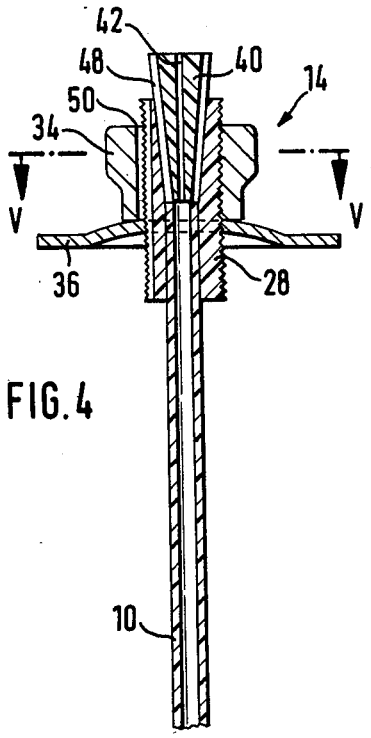
FIG. 4 is an illustration of another example of an embodiment corresponding to FIG. 1.
Figure 5:
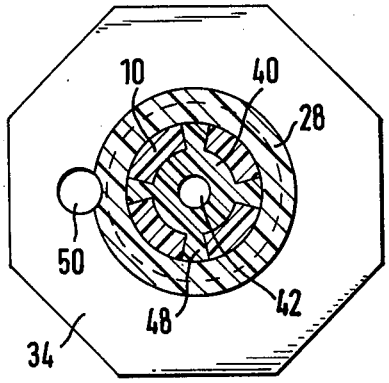
FIG. 5 is a cross section along the line V—V of FIG. 4.
Figure 6:
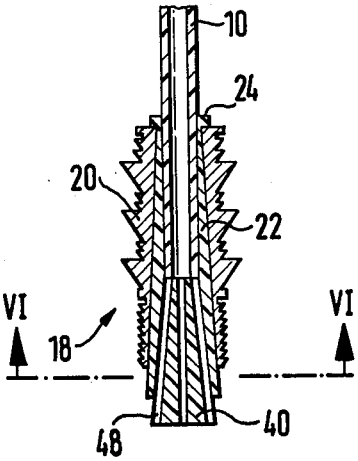
FIG. 6 is a cross-section along line VI—VI of FIG. 4.
Figure 6:
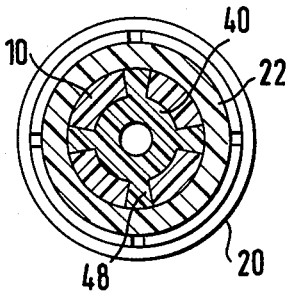

In the modification shown in FIGS. 4 to 6 the two cross wedges or spreading wedges 40 are of a radial or star-like shape with the arms or projections 48 formed thereby engaging into slots 38 of the conically widened ends 12 and 16 respectively of the tensioning element 10 and thereby closing said ends. In this manner, even under greater tensile stresses, the glass fibers of the tensioning element will not be displaced into the slot 38.

As may be seen from FIG. 4, the tensioning jacket 28, which in this embodiment is formed of glass fiber reinforced synthetic resin, has a cylindrical outer shape, while its opening is conically widened to the outside; the conically widened, slotted end of the tensioning element 10 is forced against the conical inner surface of the opening by means of cross wedge 40. In this embodiment of the tensioning means 14, cross wedge 40 with its injection bore 42 is positioned in an easily accessible manner at the head of the rock anchor and may therefore be operated more easily.

As shown in FIGS. 4 and 5, injection grooves 50 are each formed in the outer surface of tensioning jacket 28 and the inner surface of clamping nut 34, which being paired with another form a longitudinal bore. Through this longitudinal bore a hardenable synthetic resin may be injected for filling the bore hole in the event that adverse properties of the rock material require so. This injection bore is particularly advantageous for an upward anchoring of the rock because the synthetic resin will easily reach under clamp nut 34.

Figure 7:
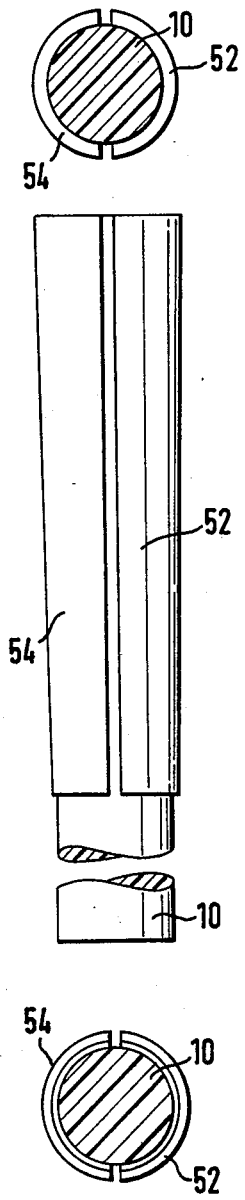
FIG. 7 is a side view of a tensioning element in the form of a rod with mounted wedge shells, and comprises two corresponding cross sectional views of the tensioning element and the mounted wedge shells.

In FIG. 7 a rod-shaped tensioning element 10 is shown in a with part of the tensioning element being omitted. Onto tensioning element 10 two wedge shells 52 and 54 are placed, the outer diameter of which being slightly tapered downwardly in the drawing. FIG. 7 also shows corresponding cross sectional views through this embodiment at the respective upper and lower ends of the mounted cross wedges.

Figure 8:
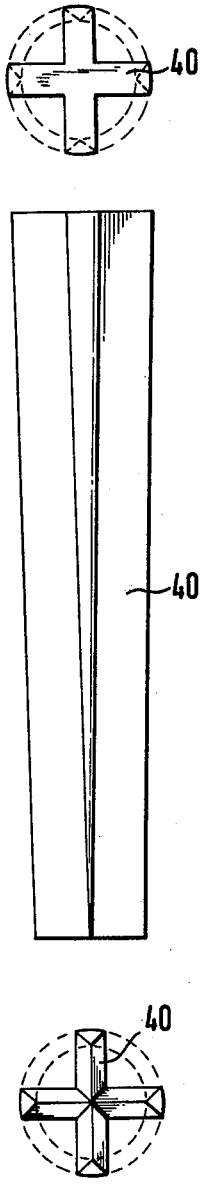
FIG. 8 is a top view, side view and bottom view of a cross wedge.

FIG. 8 illustrates a cross wedge for insertion into corresponding crosswise slots in a rod-shaped tensioning element.

Figure 9:
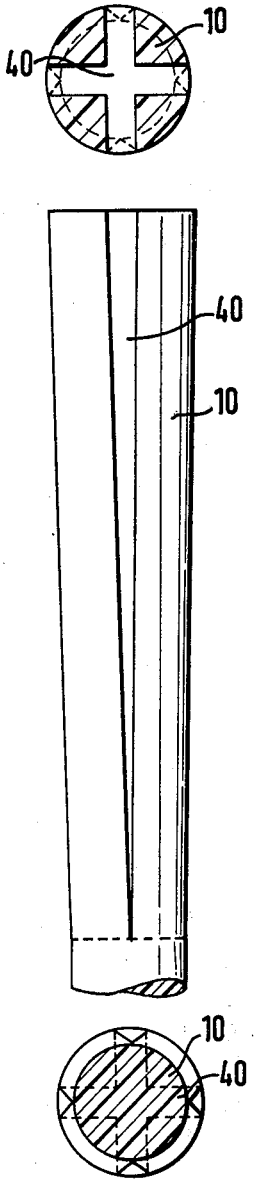
FIG. 9 is a side view of a rod-shaped tensioning element with a cross wedge inserted into corresponding crosswise slots, and comprises two corresponding sectional views of the tensioning element.

In FIG. 9 a partial view of a tensioning element with a solid, rod-like configuration is shown which has slots crosswisely arranged, into which a cross wedge according to the embodiment of FIG. 8 is inserted.

According to another embodiment of the invention, the injection bore may as well be provided in the reinforced wall of the tensioning jacket to avoid a weakening thereof by said injection groove.

Further to the advantages already named the rock anchor according to the invention has the particular advantage that it may be installed and mechanically tensioned directly during gallery constructions, while filling with synthetic resin may be performed lateron, if necessary.

Further, even without mechanical spreading means, the end of the tensioning element widened by the cross wedge of the rock anchor may inserted into a so-called adhesive cartridge which has been installed in the bore hole earlier. After the adhesive cartridge which was pierced by the tensioning element has hardened, the anchor may thus be pre-tensioned and subsequently be filled with synthetic resin.

What I claim is:

1. A rock anchor assembly comprising a tensioning element of constant diameter adapted to be inserted into a bore hole and clamped therein, the outer end thereof adapted to project from said bore hole and being adapted to be tensioned against a rock wall by means of an anchor plate, the inner end thereof for insertion into the bore hole being provided with a spreading jacket for clinging to the surface of said bore hole and being adapted for tensioning with the inner end of said tensioning element by means of a conical spreading wedge disposed around said tensioning element and secured thereto by means of a conical spreading wedge means disposed within the inner end of said tensioning element upon turning a clamp nut, said clamp nut being secured on a threaded tensioning jacket adapted for tensioning with the outer end of said tensioning element with the aid of conical tensioning wedge means disposed around said outer end upon turning the clamp nut.

2. A rock anchor assembly according to claim 1, wherein said tensioning element of constant diameter is tubular.

3. A rock anchor assembly according to claim 2, wherein both ends of said tensioning element have mechanical properties such that they can be conically widened and wherein said spreading wedge(s) means and said tensioning wedge means respectively have axial injection bores for receiving a filling material.

4. A rock anchor assembly according to claim 1, wherein radial slots are formed crosswise in the tensioning element ends adapted to be conically widened and wherein the conical spreading wedge means are provided with radial arms for engaging into said slots.

5. A rock anchor assembly according to claim 1, wherein said tensioning element of constant diameter is a smooth or roughened glass fiber reinforced plastic pipe.

6. A rock anchor assembly according to claim 1, wherein said tensioning element of constant diameter is a rod.

7. A rock anchor assembly according to claim 1, wherein said spreading wedge means and said tensioning wedge means, respectively, comprise conical wedge shells which are placed on both ends of said rod like tensioning element.

8. A rock anchor assembly according to claim 6, wherein the ends of said rod-like tensioning element are provided with slots for insertion of cross wedges.

9. A rock anchor assembly according to claim 1, wherein the outer surface of said tensioning jacket and the inner surface of said clamp nut is provided with injection grooves for receiving a filling material.

10. A rock anchor assembly according to claim 1, wherein both ends of the tensioning element are adapted to be conically widened, both ends being provided with spreading wedges having axial injection bores for a filling material and radial slots being formed crosswise in both ends, the spreading wedges being provided with radial arms engaging into said slots, and wherein said tensioning jacket comprises on at least a part of its length a conically shaped opening corresponding to said conically widened outer end of said tensioning element.

11. A rock anchor assembly according to claim 3, wherein the outer end of said tensioning element is conically widened and said tensioning jacket comprises a conically shaped opening on at least a part of its length corresponding to said conical widened end of said tensioning element.

12. A rock anchor assembly according to claim 7, wherein said tensioning jacket comprises a conically shaped opening on at least a part of its length corresponding to said wedge shells.

13. A rock anchor assembly according to claim 9, wherein the outer surface of said tensioning jacket is provided with an injection groove for receiving a filling material.

14. A rock anchor assembly according to claim 9, wherein the inner surface of said clamp nut is provided with an injection groove for receiving a filling material.

* * * * *